US005277120A

United States Patent [19]

Campoli et al.

[11] Patent Number: 5,277,120

[45] Date of Patent: Jan. 11, 1994

[54] EXTENDED CHARGE CARTRIDGE ASSEMBLY

[75] Inventors: Ralph F. Campoli, Mine Hill, N.J.; John T. McGovern, Lancaster, Pa.

[73] Assignee: Olin Corporation, Cheshire, Conn.

[21] Appl. No.: 990,472

[22] Filed: Dec. 14, 1992

Related U.S. Application Data

[63] Continuation-in-part of Ser. No. 803,806, Dec. 9, 1991, Pat. No. 5,183,961.

[51] Int. Cl.[5] ..... F42B 5/02; F42B 14/08; C06C 5/00

[52] U.S. Cl. ..... 102/470; 102/275.1

[58] Field of Search ..... 102/430, 469, 470, 275.1, 102/275.4-275.8

[56] References Cited

U.S. PATENT DOCUMENTS

| | | | |
|---|---|---|---|
| H940 | 8/1991 | Roller | 102/430 |
| 420,623 | 2/1890 | Holland | 102/439 |
| 4,444,114 | 4/1984 | Bisping et al. | 102/430 |
| 4,524,695 | 6/1985 | Bisping et al. | 102/520 |
| 4,542,696 | 9/1985 | Bisping et al. | 102/430 |
| 4,671,182 | 6/1987 | Zierler et al. | 102/521 |
| 4,763,577 | 8/1988 | Romer et al. | 102/430 |
| 4,917,017 | 4/1990 | Beltz | 102/470 |
| 4,936,220 | 6/1990 | Burns et al. | 102/521 |
| 4,964,342 | 10/1990 | Schleicher | 102/521 |
| 4,967,668 | 11/1990 | Warren | 102/522 |
| 4,974,517 | 12/1990 | Kraft et al. | 102/521 |
| 5,063,855 | 11/1991 | Diel et al. | 102/521 |
| 5,129,324 | 7/1992 | Campoli | 102/470 |
| 5,155,295 | 10/1992 | Campoli | 102/470 |

*Primary Examiner*—David H. Brown
*Attorney, Agent, or Firm*—H. Samuel Kieser

[57] ABSTRACT

A cartridge assembly for propelling a subcaliber penetrator through a gun tube which has a portion of the propellant charge contained in an annular cavity surrounding the sabot is disclosed. The annular cavity is defined by the scoop shaped front bourrelet, the aft bourrelet which has three radially extending support posts and bore riding shoes, and a combustible tubular case extension over the aft bourrelet extending forward to the front bourrelet. The assembly includes cartridge case having a multistrand ignition system having a plurality of flexible combustible ignition strand. The strands extend through the propellant charge in the case and extend between the posts of the aft bourrelet into the annular cavity to simultaneously ignite the propellant charge contained therein with the portion of the charge in the cartridge case.

2 Claims, 5 Drawing Sheets

EXTENDED CHARGE CARTRIDGE ASSEMBLY

CROSS REFERENCE TO RELATED APPLICATION

This application is a continuation in part of U.S. patent application Ser. No. 07/803,806, filed Dec. 09, 1991, now U.S. Pat. No. 5,183,961, issued Feb. 2, 1993, which is generally related to U.S patent application Ser. No. 07/773,758, filed Oct. 11, 1991, now U.S. Pat. No. 5,155,295, issued Oct. 13, 1992, which is a continuation of U.S. Ser. No. 07/429,461, filed Oct. 19, 1989, now abandoned; and U.S. Ser. No. 07/644,726, filed Jan. 23, 1991, now U.S. Pat. No. 5,129,324, issued Jul. 14, 1992, which is a divisional of U.S. Ser. No. 07/429,461, filed Oct. 28, 1989, now abandoned.

BACKGROUND OF THE INVENTION

1. Field of the Invention

This invention generally relates to large caliber ammunition and more particularly to armor penetrating, fin stabilized discarding sabot (APFSDS) projectile cartridges.

2. Discussion of the Related Art

A large caliber APFSDS cartridge typically has a combustible case attached to a saboted long rod penetrator. The sabot has a front bore riding support or bourrelet and a rear bore riding support or bourrelet. The case is attached to the aft bourrelet on the sabot. The aft bourrelet is a solid cylindrical portion that forms a closure on the case mouth, thus retaining the propellant in the case. The front bourrelet is spaced from the case mouth and includes a scoop to catch onrushing air upon projectile exit from the gun tube. The scoop shaped front bourrelet permits onrushing air to separate the segments of the sabot from the fin stabilized long rod penetrator. The propelling gases push against the aft face of the aft bourrelet to push the Projectile through the tube. When such a cartridge is inserted in the gun chamber, there is a toroidal void formed between the front and aft bourrelets and the inside surface of the gun tube. This void conventionally serves no useful function.

U.S. Pat. No. 4,964,342, issued to Schleicher on Oct. 23, 1990, discloses a sabot arrangement for an APFSDS projectile having front and aft bourrelets which has passages through the aft bourrelet. The passages through the aft bourrelet permit propelling gases to act upon the rear face of the front bourrelet to pull the saboted projectile through the gun tube.

U.S. Pat. No. 4,974,517, issued to Kraft et al on Dec. 4, 1990, discloses an APFSDS round with passages through the aft bourrelet connecting the space between the bourrelets with the propellant case. A combustible, or thin rupturable barrier separates the propellant in the case from the passage into the void between the bourrelets.

U.S. Pat. No. 4,936,220, issued to Burns et al on Jun. 26, 1990, discloses a saboted projectile having a scoop front bourrelet and a cylindrical rear bourrelet with a tubular sleeve between them made of a combustible material. Several plugged through bores through the aft bourrelet connect the toroidal cavity between the bourrelets with the rear face of the aft bourrelet. A portion of the propelling charge is contained within the toroidal cavity. This portion of the charge is sequentially ignited after ignition of the main charge by an igniter mounted in an unsealable blowout plug in the through bore or a delay charge/seal positioned in each of the through bores.

In accordance with the present invention a cannon cartridge propellant ignition assembly is provided for connecting to a primer hear and a cartridge case. The head contains an ignition device and an ignition charge therein. The assembly comprises a solid ignitor strand adaptor body having an open end adapted to mate and engage with the primer head. An internal ignition chamber is adapted to communicate with the ignition charge and a plurality of through bores extend through the adaptor into the chamber. A tubular metal sleeve is pressed into each of the bores. A plurality of flexible ignition strands is provided, each having one end frictionally clamped by and extending through one of the tubular sleeves so as to communicate into the ignition chamber. Each of the sleeves confine a portion of the strand at the end which is fixturally clamped into the sleeve in order to generate a high order propagation rate upon ignition.

The confinement method to initiate high order detonation of ignition strands has been achieved. This detonation propagation rating is on the order of 3,000 to 6,000 feet per second.

The concept here is to sustain the pressure peak as the propelled projectile moves through the gun tube by providing an additional "traveling charge" located in a sabot, and particularly in an APFSDS type round, and determining how to assemble the cartridge to allow this to work in a practical way.

BRIEF DESCRIPTION OF THE DRAWINGS

The features and advantages of the present invention will be better understood from a reading of the following detailed description when taken in conjunction with the drawings, in which.

DETAILED DESCRIPTION OF THE INVENTION

Figure 1:
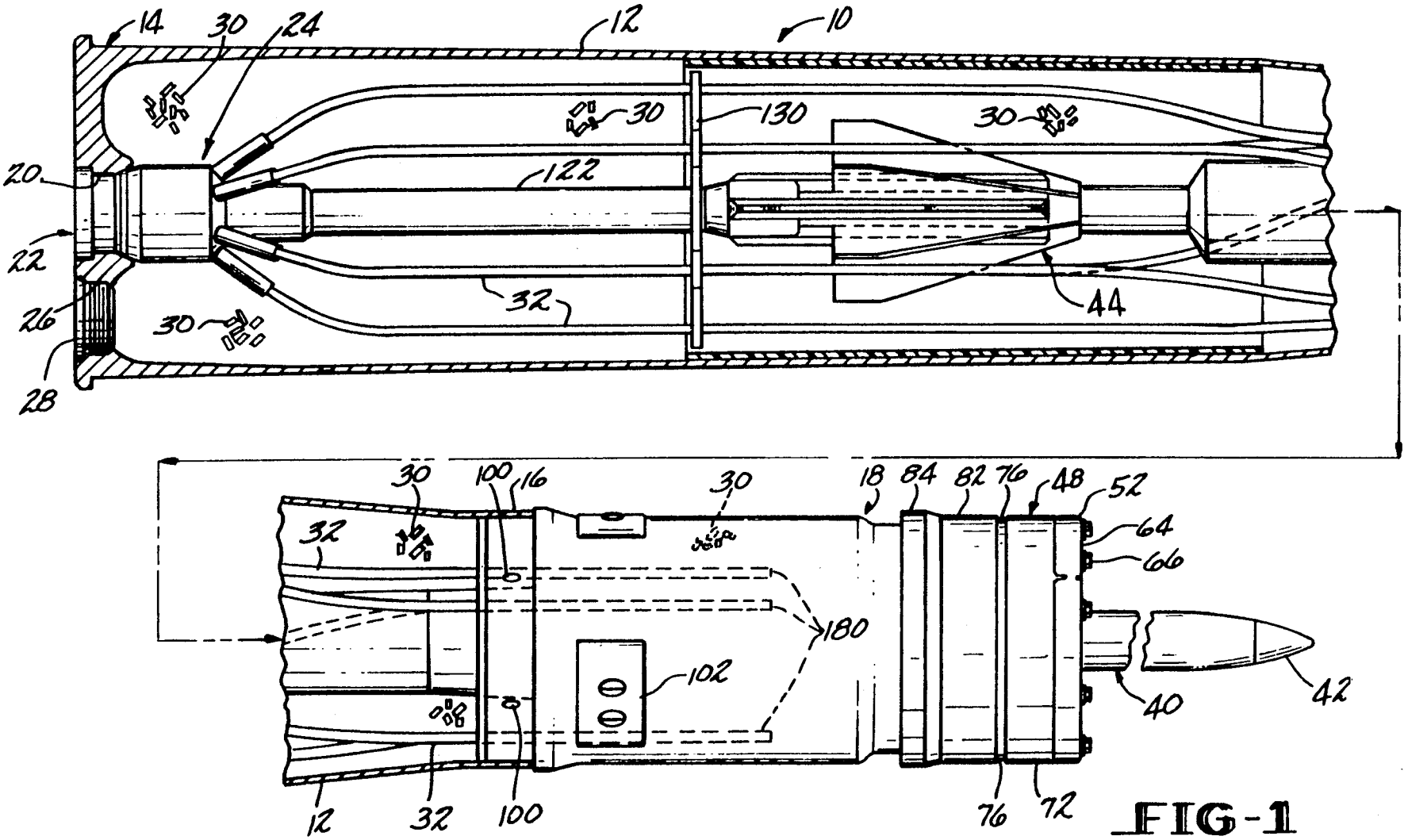
FIG. 1 is a longitudinal side view, with portions sectioned, of the cartridge assembly of the invention.

A fully assembled cartridge 10 utilizing the propelling ignition assembly of the present invention is shown in a side view with partial sections broken away in FIG.

1 Cartridge 10 basically includes a tubular case 12 having a closed head end 14 and an open mouth end 16. A projectile assembly 18 extends into and is secured to the case mouth 16. The head end 14 of the case 12 contains a central through bore 20 which is closed by a primer head loading adapter assembly 22 and a multistrand primer assembly 24. Head 14 also has a radially offset through bore 26 which is closed by a case plug 28. During assembly of the cartridge 10, a propellant 30 is loaded into the case 12 through the through bore 26. Installation of the case plug completes the assembly. The primer assembly includes a plurality of ignition strands 32 which extend through the case 12 and into the projectile assembly to provide substantially simultaneous ignition of the entire propellant bed as will be subsequently described.

Casing 12 may be an all metal body or may be a combustible case body having a metal head closing the head 14 of the cartridge 10. Casing 12 may be a straight cylindrical tube or may have the mouth end necked down to a smaller bore diameter as is shown in FIG. 1. Primer head adapter assembly 22 and the multistrand primer assembly 24 are threaded together to sandwich the case head end 14 therebetween.

Figure 2:
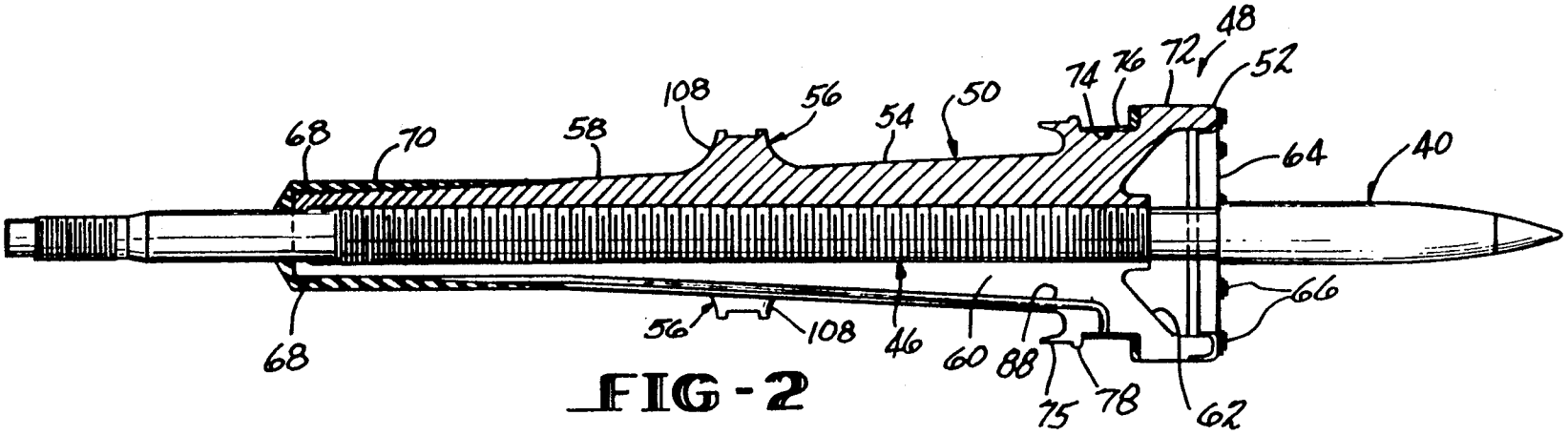
FIG. 2 is a partial sectional side view of the penetrator assembly in accordance with the invention.
Figure 3:
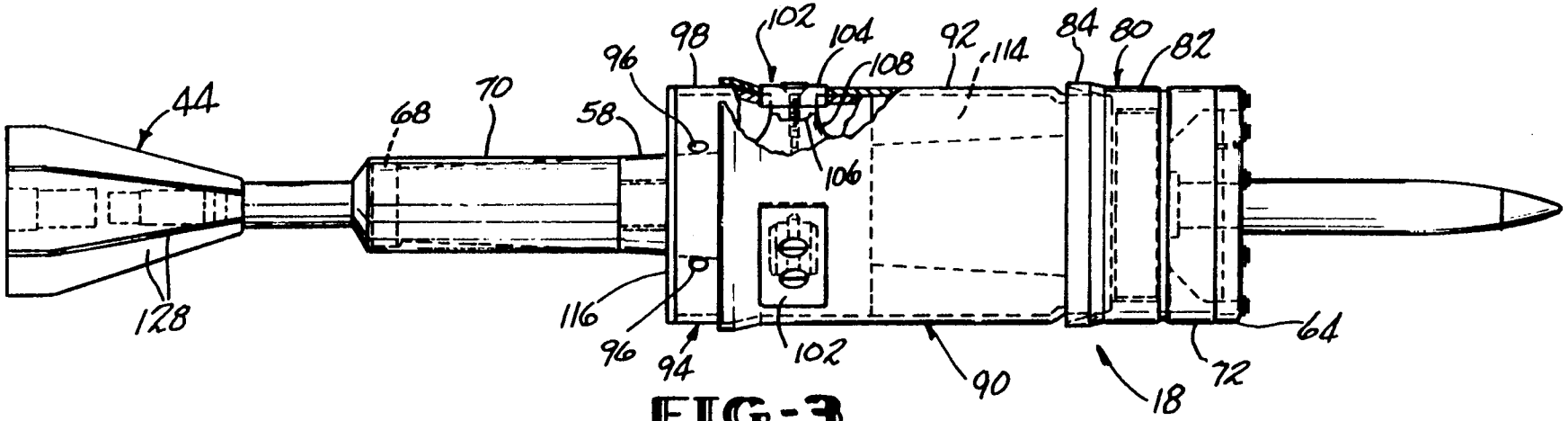
FIG. 3 is a side view of the saboted projectile assembly and case extension in accordance with the invention.

The projectile assembly 18 is shown partially and fully assembled in FIGS. 2 and 3 respectively. The projectile assembly 18 includes a long rod shaped penetrator 40 which has a pointed front tip 42 and a fin assembly 44 attached to the rear of the penetrator 40. The penetrator 40 has an externally threaded portion 46. The long rod penetrator 40 is preferably made of tungsten or other hard metal material, and the tip 42 comprises a plastic aerodynamic shroud.

Referring now to FIGS. 2 and 3, the threaded portion 46 of the penetrator 40 is encircled by a sabot assembly 48 which has three 120° sabot segments 50. Each sabot segment 50 has a front bourrelet portion 52, a rearwardly tapered central portion 54, an aft bourrelet 56, and a tapered rear portion 58. The segments 50 may be made of any desired material such as a composite plastic material or a light weight metal material such a aluminum. Each sabot segment 50 has two flat radial faces 60 which extend axially from front to rear. The segments 50 are joined with faces 60 abutting one another around the penetrator 40 to form full bore sabot 48.

The front bourrelet 52 of the sabot 48 has a scoop shaped front face 62. An annular metal bourrelet ring 64 having a U-shaped cross section is fastened via bolts 66 to the outer periphery of the scoop shaped front face 62 of the sabot segments 50 to hold the front bourrelet portions 52 together. The aft end of the sabot segments 50 are held together by a retaining band 68 which is pressed over the rear end of the segments placed around the penetrator 40. An aft seal sleeve 70 preferably formed of rubber or RTV is formed as by molding in place over the tapered rear portion 58 of the sabot 48 after the retaining band 68 is installed. This seal primarily protects the rear of the sabot 48 from the heat of the combustion gases during the ballistic cycle.

The front bourrelet 52 of the sabot 48 has a cylindrical outer bore riding portion 72 adjacent the bourrelet ring 64. Bourrelet 52 also has an annular U shaped channel 74 and a rearwardly extending flange 75 behind the bore riding portion 72. A seal band 76 preferably made of polypropylene and which preferably has an L shaped cross section is installed within the channel 74. The band 76 is preferably heated and stretched to snap fit over an outwardly projecting annular retaining ridge 78 between the flange 75 and the channel 74 into the channel 74. The band 76 then cools and shrinks in place. This band provides a low friction support for an annular obturator 80 as is shown in FIGS. 3, 4 and 5.

Figure 4:
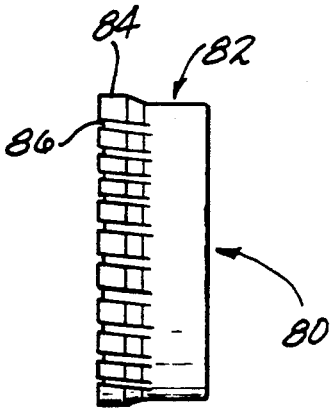
FIG. 4 is a side view of the obturator in accordance with the present invention.
Figure 5:
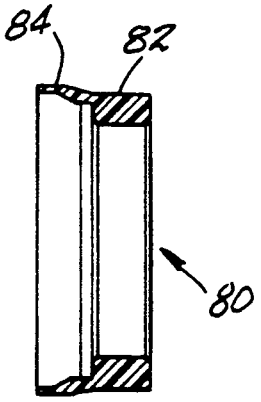
FIG. 5 is a sectional view of the obturator shown in FIG. 4.

The obturator 80, shown in a side view in FIG. 4, is installed over the seal band 76 in the channel 74 in a similar manner. The obturator 80 is preferably made of Zytel 101 nylon and has a cross section as shown in FIG. 5. Obturator 80 has a body portion 82 with a generally rectangular cross section and an outwardly flared annular flexible sealing portion 84. The flexible sealing portion 84 has a series of helical grooves 86 which complement and engage corresponding lands in the rifled gun tube of the cannon in which the cartridge of the invention is loaded. The body portion 82 slidably rotates on the seal band 76 in the annular channel 74 to permit the helical grooves 86 to engage with the corresponding lands in the rifled gun tube. During the ballistic ignition and acceleration phase, the obturator spins to maintain the projectile/bore seal without imparting significant spin to the projectile itself. The grooves 86 are omitted from the obturator if the cartridge of the invention is designed for use in a smooth bore gun such as the 120 mm cannon.

Referring again to FIG. 2, each sabot segment 50 has an axially extending C shaped groove 88 in the radial face 60 extending from the annular channel 74 rearward adjacent the outer surface of the sabot segment 50 to the rear of the tapered rear portion 58. When the segments 50 are joined, these grooves 88 match to form a passage extending from the channel 74 to the rear portion 58. This passage is filled with a sealant material such as JRTV during assembly of the sabot segments on the penetrator 40 in order to completely seal the sabot projectile assembly along each of the joints between the segments 50.

Referring now to FIGS. 1 through 3, the projectile assembly 18 includes the penetrator 40, the sabot assembly 48, and an outer case extension assembly 90. The outer case extension assembly 90 includes a case extension 92 which is a combustible sleeve that fits over the aft bourrelet 56. The front end of the case extension 92 fits under the flexible sealing portion 84 of the obturator 80 and over the annular ledge 75 so as to butt up against the ridge 78. A tubular combustible case extension support 94 is adhesively fastened to the inside of case extension 92. The case extension support 94 is a combustible sleeve which has a plurality of circumferentially spaced holes 96 in an after skirt portion 98 for fastening the skirt portion 98 to the mouth 16 of the cartridge case 12 with expansion rivets 100.

The case extension support 94 and case extension 92 are secured to the sabot segments 50 via three sabot shoes 102 which are bolted onto the aft bourrelet 56 of each sabot segment 50. The sabot shoes 102 each have a curved, rectangular, outer bore riding surface portion 104 having a surface curvature corresponding to the land to land diameter of the gun bore. The sabot shoe 102 further has a keyed base portion 106 which fits into a correspondingly notched outwardly extending portion 108 of the aft bourrelet 56.

Figure 6:
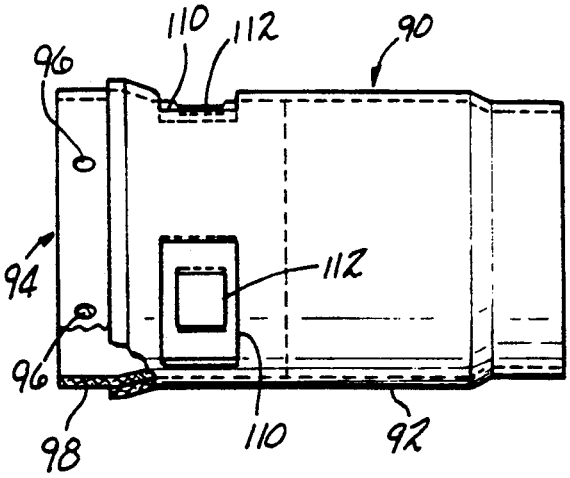
FIG. 6 is a side view of the case extension assembly in accordance with the present invention.
Figure 7:
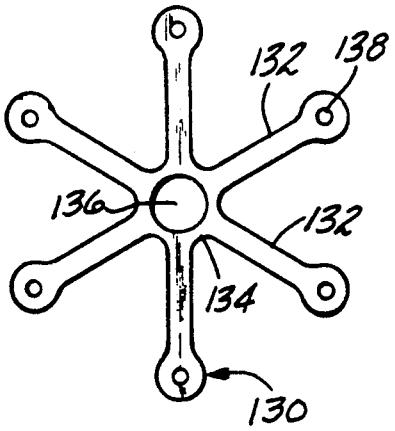
FIG. 7 is a front view of the aft strand support.

Each sabot shoe base portion 106 also fits, as shown in FIG. 6, through a corresponding rectangular cutout 110 in the case extension support 94. The outer surface portion 104 of the sabot shoe 102 correspondingly fits within a cutout 112 in the case extension 92. The sabot shoes 102 firmly lock the case extension support 94 and case extension 92 firmly in place on the sabot 48.

Referring again to FIG. 3, assembled, the projectile assembly 18 defines a toroidal cavity 114 that is open, via the space between the sabot shoes 102 and the post portions 108 of the aft bourrelet 56, to the interior of the projectile casing 12. The cavity 114 is bounded by the inside surface of the combustible case extension assembly 90, the front bourrelet 52, the central portion 54, and the aft bourrelet 56. Accordingly, propellant 30, loaded into the case 12 through the loading bore 26, also enters into and fills the toroidal cavity 114 during loading. Thus the toroidal cavity 114 formed by the case extension assembly 90 surrounding the sabot 48 operably extends the length of the propellant containing case, and its volume, up to the aft face of the front bourrelet 52.

Figure 9:
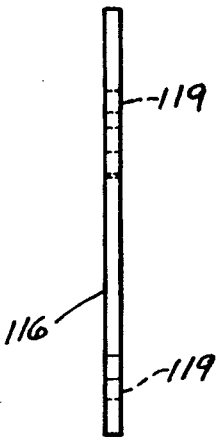
FIG. 9 is a side view of the front strand support shown in FIG. 8.
Figure 8:
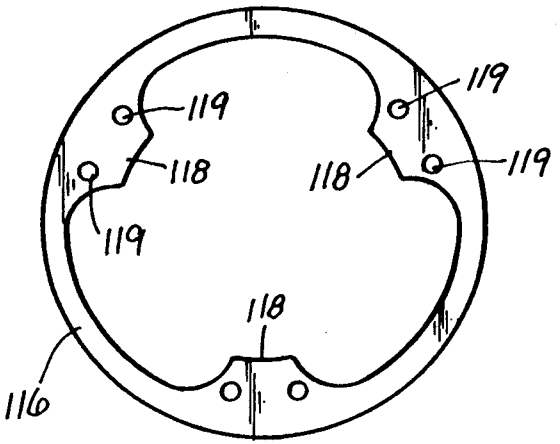
FIG. 8 is a front view of the front strand support.

Adhesively glued to the rear annular face of the case extension support 94 is a front ignition strand support 116. The front ignition strand support 116 is shown separately in front and side views in FIGS. 8 and 9 respectively. The front ignition strand support 116 is a flat annular body of combustible material such as nitrocellulose having three radially widened portions 118 extending inward and symmetrically spaced around the perimeter of the body 116. Each of the widened portions 118 has a pair of holes 119 therethrough. These holes are sized to receive and support individual ignition strands as will be subsequently described. The front strand support 116 is positioned against and glued to the aft face of the case extension support 94 so that the widened portions are between the shoes 102 and thus directly in line into the toroidal cavity 114.

Figure 10:
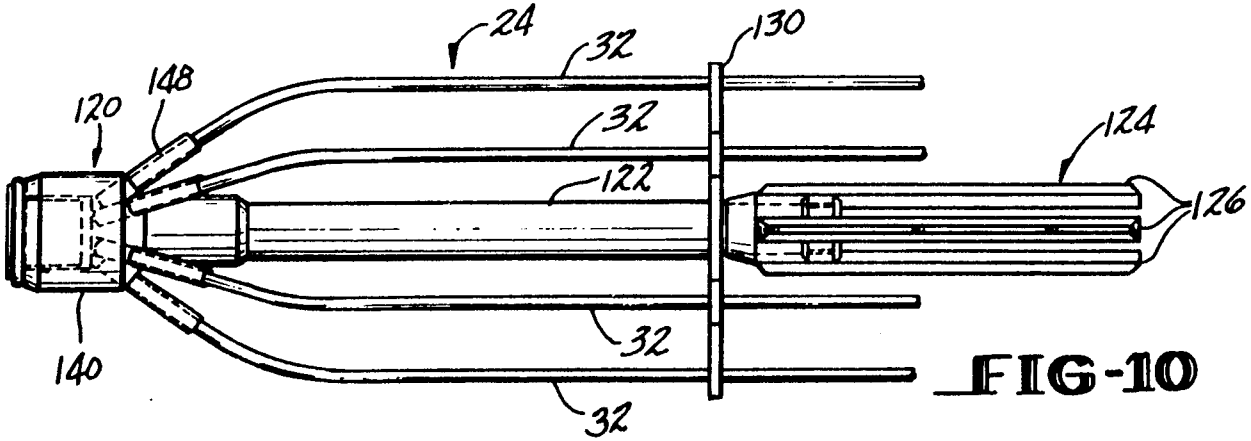
FIG. 10 is a side view of the primer assembly in accordance with the present invention.

The multistrand primer assembly 24 is shown assembled in the cartridge 10 in FIG. 1 and separated from case 12 in FIG. 10. Primer assembly 24 includes a generally cylindrical metal strand adapter assembly 120 to which is connected a plurality of ITLX ignition strands 32, preferably six, each spaced 60° from one another about a central axis A. The ignition strands 32 are plastic tubes containing a fast burning ITLX ignition cord structure which is preferably commercially available from Atlas Powder Company. The strands 32 are described in detail in U.S. Pat. No. 4,917,017, issued to Donald R. Beltz on Apr. 17, 1990.

A cylindrical fin support shaft 122 has one end threadably connected to the strand adapter assembly 120 and the other end threadably connected to a fin support finger assembly 124. Fin support finger assembly 124 has preferably three extending fingers 126 which slidably extend between the fins of the fin assembly 44 attached to the rear end of the penetrator 40. The fin support shaft and fin support finger assembly 124 are designed to permit movement of the penetrator 40 of the projectile assembly 18 only in an axial direction out of the projectile case 12 and thus provide lateral support to the aft end of the projectile assembly 18.

An aft strand support 130 made of a combustible casing material such as felted nitrocellulose, is slidably fastened to the fin support shaft 122 and holds a midportion of the igniter strands 32 in a spaced relation about the central axis A.

In the embodiment shown in FIGS. 1 and 10, only 1 support 130 is shown. Depending on the case length, more may be placed on the fin support shaft 122. The aft strand support 130 is a flat body having six radially extending legs 132 extending symmetrically from a disk shaped entrance portion 134 having a central through bore 136. Each leg 132 terminates in a hole 138 through which the ignition strand 32 passes. The aft strand support 130 is thus a flat spider shaped support which maintains the ignition strands 32 in a circumferentially and radially spaced position during assembly, storage, loading, and use of the cartridge 10 in accordance with the present invention.

Figure 11:
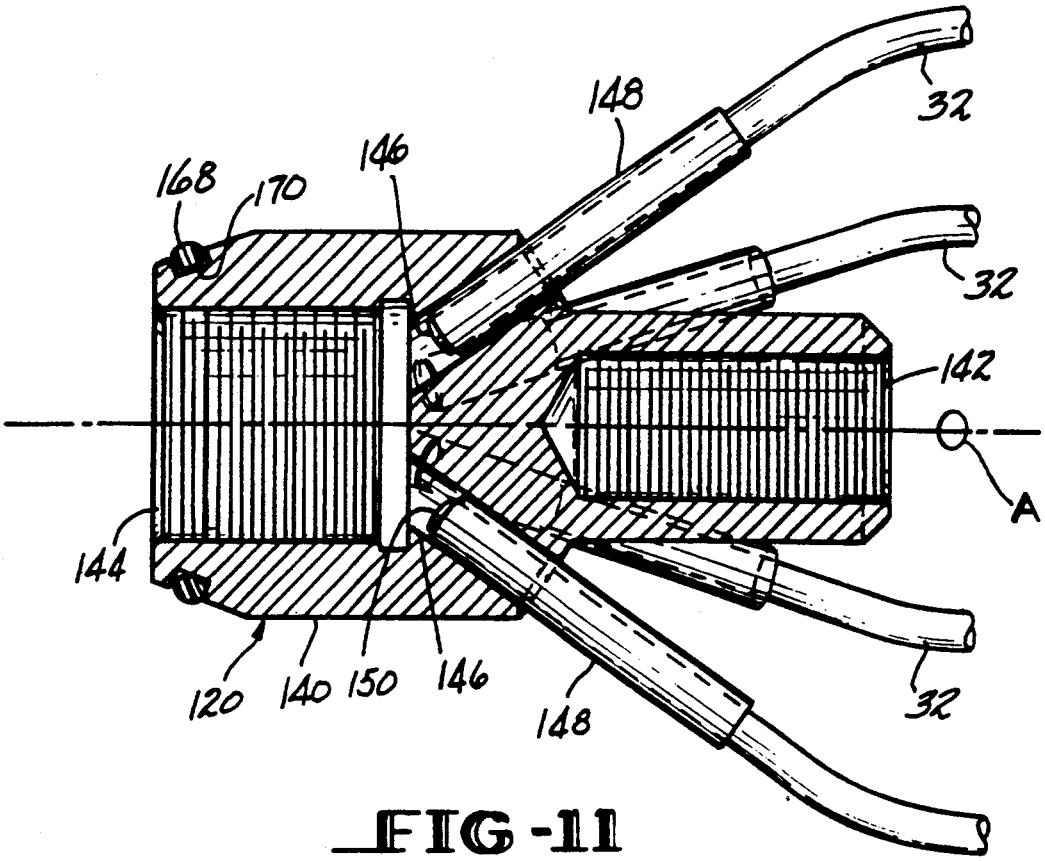
FIG. 11 is an enlarged sectional view of the strand adapter assembly in accordance with the present invention.

The strand adapter assembly 120 is shown in FIG. 10 and in an enlarged view, in FIG. 11. The strand adapter assembly 120 comprises a generally cylindrical metal body 140 having a front threaded blind bore 142 which receives the rear end of the fin support shaft 122 and a threaded blind bore 144 through the aft end of the strand adapter body 140. Six radially symmetrical through bores 146 extend through the strand adapter body 140 between the blind bores and into the aft blind bore 144. The blind bores 146 are preferably equally spaced circumferentially about the axis A and preferably extend into the threaded blind bore 144 at an angle so that the axis bore intersect axis A at a common point.

A strand adapter lock 148 is frictionally press fit into each bore 146. Each adaptor lock 148 is at least approximately 1½ inches long. The aft end 150 of each ignition strand 32 is pushed through the strand adapter lock 148. The ends 150 extend slightly beyond the inner ends of the strand adapter locks 148 and communicate with the aft blind bore 144.

Figure 12:
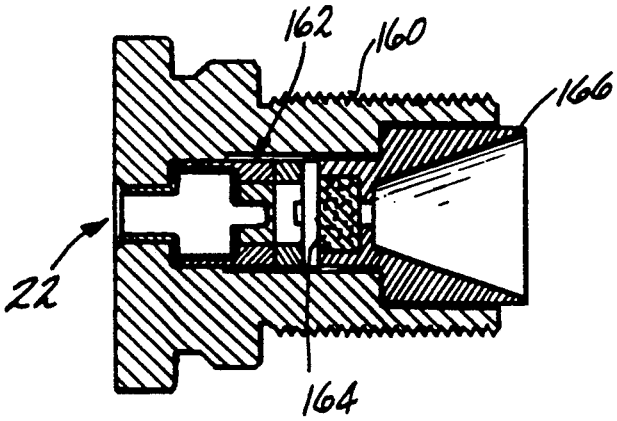
FIG. 12 is a longitudinal sectional view of the primer head loading adapter assembly in accordance with the present invention.

The primer head loading adapter assembly 22 is threaded into the threaded blind bore 144 to fasten the primer assembly 24 to the case head 14 as shown in FIG. 1. As shown in FIG. 12, the primer head loading adapter assembly 22 comprises a metal threaded plug primer head 160 which has an ignition element assembly 162 mounted therein and insulated therefrom. The ignition element assembly 162 includes an ignition charge and may contain a bridge wire that ignites an ignition charge 164 of black powder when electrical current is passed through the wire. The flame from the ignited charge 164 passes through a conical cavity in a plug 166 which is threaded into the primer head 160.

Cartridge 10 in accordance with the present invention requires a different assembly procedure than is currently utilized in ammunition.

As noted in the Background discussion above, in conventional ammunition construction the primer assembly is loaded into the case, propellant is added, and finally the projectile assembly is inserted into and fastened to the case mouth. Alternatively, where the projectile assembly projects deeply into the case, the cartridge case may be fastened to the rear of the projectile assembly and inverted. The propellant granules or propellant sticks are then inserted around the fin assembly on the projectile within the case. The case stub tube or head is then snap fit, adhesively bonded, or threaded onto the combustible cartridge case. Finally, a primer is threaded into the case base or head to complete the assembly.

In contrast, the cartridge 10 according to the present invention requires assembly of the entire cartridge assembly first and then finally, loading of the propellant. Assembly of the cartridge is done in several different steps, each uniquely different than prior cartridge assembly methods.

An inner portion of a puller-type discarding sabot is placed around the an APFS penetrator (see FIG. 2) and then a combustible sheath is placed around the puller sabot (see FIG. 3) to define a rearwardly open, forwardly closed annular cavity. A candelabra-like multistrand igniter assembly (see FIG. 10) is then attached to the rear of the penetrator and the strands placed into the rearwardly open cavity the puller sabot. The sabot, sheath and igniter assembly is then placed as a unit into a cuplike cartridge case and the igniter assembly attached to the casehead in communication with a primer and with the sheath attached to the front open end of the case (see FIG. 1).

Assembly of the cartridge of the present invention preferably proceeds generally as follows. The three sabot segments 50 are positioned around the threaded portion 46 of the long rod penetrator 40. The retaining band 68 is then pressed onto the rear tapered portion 58 of the sabot 48. The bourrelet ring 62 is then bolted via bolts 64 to the front bourrelet 52. RTV or similar sealant is then force fed through the passage formed by grooves 88, and the aft seal sleeve 70 is molded in place on the tapered rear portion 58.

The seal band 76, preferably made of polypropylene, is heated and then stretched over ridge 78 and into annular channel 74 on the front bourrelet 52 and allowed to cool. The obturator 80 is then similarly heated and then snapped over and onto the seal band 76 in the annular channel 74 and allowed to cool.

Next, the case extension support 94 and case extension 92 are adhesively bonded together and the assembly 90 slid over the rear end of the sabot 50 so that the front end of the case extension 92 fits under the lip 84 of the obturator 80 onto ledge 75 so as to abut ridge 78. The front strand support 116 is then adhesively bonded to the rear skirt portion 98 of the case extension support 94.

Finally, fin assembly 44 is then threadably installed on the rear end of penetrator 40 and the sabot shoes 102 are threadably installed onto the outer post portions 108 of the aft bourrelet 56 to complete the assembly of the case and projectile assembly 18 as shown in FIG. 3.

The primer assembly 24 is assembled separately. The fin support finger assembly 124 is threaded onto the front end of the fin support shaft 122 and aft strand support 130 is then slid on to the fin support shaft 122. The fin support shaft 122 is then threaded into the blind bore 142 of the strand adapter 140. The six strand adapter locks 148 are then pressed into bores 146 and the rear ends of the igniter strands 32 are pressed through the strand adapter locks 148 so that the ends 150 communicate into the threaded blind bore 144 of the strand adapter 140. Alternately, the ends 150 of the strands 32 may be inserted into the adapter locks 148 first and then installed in the bores 146. The forward ends of the igniter strands 32 are each fed through hole 138 in the arm 134 on the aft support 130. This completes the assembly of the primer assembly 24.

The primer assembly 24 is then slidably mounted onto the projectile assembly 18 by sliding the fin support fingers 126 between the fins 128 as shown in FIG. 1. The front ends 180 of the ignition strands 32 are then each fed through the corresponding holes 119 in the front ignition strand support 116 so as to extend well within the cavity 114. An O-ring 168 is then installed in an O-ring groove 170 on the strand adapter assembly and the case 12 is slid over the primer assembly 24 and onto the aft end of the projectile assembly 18. The case 12 is then rotated so that the holes in the case mouth 16 corresponding to the holes 96 in the skirt portion 98 of the case extension support 94 are aligned. Expansion rivets 100 are then installed to secure the case 12 to the projectile assembly 118. The primer head adapter assembly 22 is then threaded into the threaded blind bore 144 in the strand adapter 140 to fasten the primer assembly 24 to the case head 14.

Finally, the charge of granular propellant 30 is loaded through the bore 26 in the head 14 and the case plug 28 is installed to complete assembly of the cartridge 10.

It is to be understood that the above described embodiments of the invention are illustrative only. Modifications throughout may occur to those skilled in the art. Accordingly, it is intended that the invention is not to be limited to the embodiments disclosed herein but is defined by the scope and fair meaning of the appended claims. All patents, patent applications an other documents specifically referred to above are incorporated herein by reference in their entirety.

What is claimed is:

1. A cannon cartridge propellant ignition assembly for connecting to a primer head in a cartridge case, said head containing an ignition device and an ignition charge therein, said assembly comprising:

a solid igniter strand adapter body having an open end adapted to mate and engage with said primer head, an internal ignition chamber adapted to communicate with said ignition charge, a plurality of through bores extending through said adapter body into said chamber;

a tubular metal sleeve pressed into each of said bores; and a plurality of flexible ignition strands each having one end frictionally clamped by and extending through one of said tubular sleeves so as to communicate into said ignition chamber, each of said sleeves confining a portion of said strand at said end in order to generate a high order propagation rate upon ignition.

2. The assembly of claim 1, further comprising a rigid support adapted to engage with a rear end of a long rod penetrator projectile and attached to the adapter body so as to hold and support the flexible strands during cartridge assembly.

* * * * *